US006115005A

United States Patent [19]

Goldstein et al.

[11] Patent Number: 6,115,005

[45] Date of Patent: Sep. 5, 2000

[54] GAIN-OPTIMIZED LIGHTWEIGHT HELICAL ANTENNA ARRANGEMENT

[75] Inventors: M. Lawrence Goldstein, Palm Bay; Eric Andrew Gyorko, Indialantic; William D. Killen, Satellite Beach, all of Fla.

[73] Assignee: Harris Corporation, Melbourne, Fla.

[21] Appl. No.: 09/106,433

[22] Filed: Jun. 29, 1998

[51] Int. Cl.[7] ..... H01Q 1/36

[52] U.S. Cl. ..... 343/895

[58] Field of Search ..... 343/895, 844, 343/850; H01Q 1/36

[56] References Cited

U.S. PATENT DOCUMENTS

| | | | |
|---|---|---|---|
| 5,345,248 | 9/1994 | Hwang et al. | 343/895 |
| 5,453,755 | 9/1995 | Nakano et al. | 343/895 |
| 5,528,771 | 11/1993 | Praba | 343/895 |
| 5,541,617 | 7/1996 | Connolly et al. | 343/895 |
| 5,892,480 | 4/1999 | Killen | 343/895 |

*Primary Examiner*—Don Wong
*Assistant Examiner*—Hoang Nguyen
*Attorney, Agent, or Firm*—Charles E. Wands

[57] ABSTRACT

A gain-optimized, compact helical antenna array comprises an array of tapered pitch angle helical antenna elements. By tapered pitch angle is meant that the pitch angle increases from the base end of the antenna element to the distal end, in a manner that optimizes the gain of each helical element relative to helix length for a given physical size of the winding. Each helical winding is coupled to a signal distribution network, through which the antenna's radiation pattern is controllably defined. The antenna elements have a spatially aperiodic distribution, that reduces grating lobes, by minimizing the number of antenna elements which share the same azimuth. A radial line orthogonal to the boresight axis will intercept a minimum number of helical antenna elements of the array. To minimize mutual coupling, the mutual spacing between any two antenna elements of the array is at least a prescribed minimum separation that is proportional to a product of the square root of the gain of the respective antenna element and the wavelength of the operating frequency of the array.

16 Claims, 2 Drawing Sheets

GAIN-OPTIMIZED LIGHTWEIGHT HELICAL ANTENNA ARRANGEMENT

FIELD OF THE INVENTION

The present invention relates in general to communication systems, and is particularly directed to a new and improved compact array of high gain, axial mode helical antenna elements, distributed aperiodically around a boresight axis, in a prescribed spatial geometry and mutual separation that are effective to minimize grating lobes and optimize the gain of the antenna array.

BACKGROUND OF THE INVENTION

Because of the substantial size and weight penalties, plus aperture blockage, associated with the use of parabolic reflector antennas, communication system users are increasingly turning to reduced mass antenna arrays for high gain applications, such as, but not restricted to power-limited satellite communication terminals. A typical high gain axial mode helical antenna array may employ a plurality of spaced apart identical antenna elements, the gain of each of which is less than that of the array. Each of the elements of the array is summed by a shared signal distribution network, through which the antenna beam or radiation pattern may be controllably steered or scanned relative to the antenna's boresight axis.

A shortcoming of an antenna array of high gain antenna elements spaced sufficiently far apart to avoid mutual coupling is the presence of grating lobes of substantial magnitude, which perturb the desired sensing direction of the antenna's main beam. In addition, since grating lobes represent directivity in unwanted directions, they may reduce the effective antenna gain in the desired direction. Unfortunately, if the array elements are placed relatively close to one another, in an effort to reduce or eliminate the grating lobe problem, mutual coupling effects between the more closely spaced elements will modify the radiation patterns of the antenna elements; in an unpredictable manner, thereby distorting the composite pattern of the array.

SUMMARY OF THE INVENTION

In accordance with the present invention, these mutual coupling and grating lobe problems: of conventional high gain axial mode helical antenna arrays, described above, are substantially reduced or eliminated by means of a relatively compact helical antenna configuration, in which a plurality of reduced length, tapered pitch helical antenna elements are distributed aperiodically around the antenna's boresight axis, in a prescribed geometry and mutual separation that are effective to minimize grating lobes and optimize the gain of the overall array.

For this purpose, the gain-optimized, helical antenna architecture of the present invention comprises an array of variable or tapered pitch angle helical antenna elements mounted to one side of a support structure, that is affixed to an associated mounting and pointing arrangement. By tapered pitch angle is meant that the pitch angle successively increases from the base end of the antenna element to the distal end, in a manner that optimizes the gain of each helical element relative to helix length for a given physical size of the winding. At its base end, each helical winding is coupled to a coaxial feed-through element which passes through the support base for connection to a section of signal coupling cable from a signal distribution network, through which the antenna's radiation pattern may be controllably defined.

Pursuant to the invention, the antenna elements have a spatially aperiodic distribution, that serves to minimize grating lobes, by minimizing the number of antenna elements which share the same azimuth. This is effectively achieved by arranging the antenna elements, such that, for any given antenna element of the array, a radial line orthogonal to the boresight axis will intercept a minimum number of helical antenna elements of the array.

In addition, in order to minimize mutual coupling between elements, the mutual spacing between any two antenna elements of the array is at least twice the wavelength of the operating frequency of the antenna for a 17 dBiC helix. The mutual spacing between any two elements of the array conforms with a prescribed gain-based spacing relationship, such that any antenna element is spaced apart from any other antenna element by a minimum separation that is proportional to a product of the square root of the gain of the respective helical antenna element and the wavelength of the operating frequency of the array.

DETAILED DESCRIPTION

Figure 1:
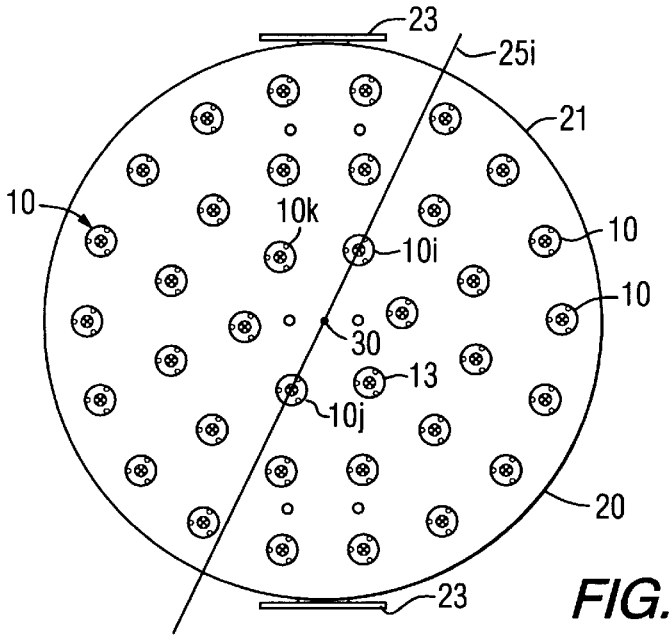
FIG. 1 is a diagrammatic front end or boresight view of a gain-optimized, helical antenna architecture in accordance with the present invention.
Figure 2:
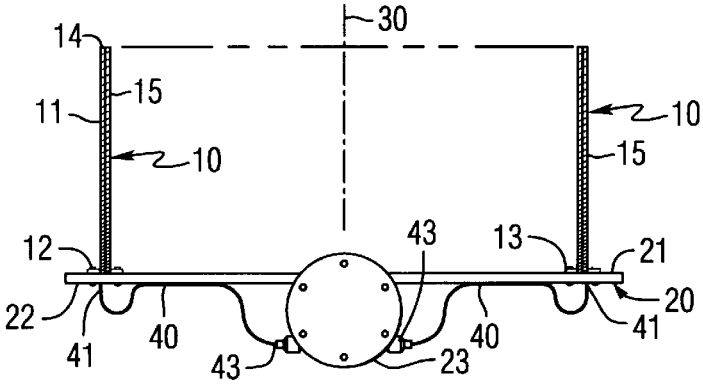
FIG. 2 is a diagrammatic side view of the gain-optimized, helical antenna architecture of FIG. 1.
Figure 3:
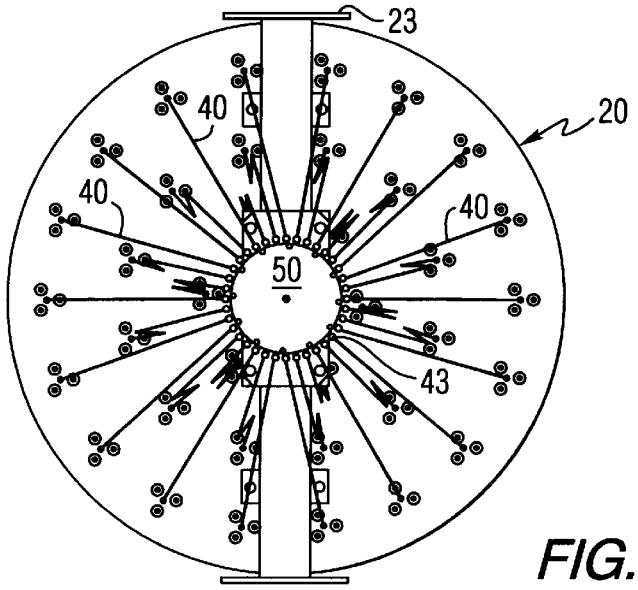
FIG. 3 is a diagrammatic rear or feed side view of the gain-optimized, helical antenna architecture of FIG. 1.

A preferred embodiment of the gain-optimized, helical antenna architecture of the present invention is diagrammatically illustrated in FIGS. 1–3, as comprising an array of axial mode helical antenna elements 10, which are mounted to a first side 21 of support structure, shown as a generally planar, circular support base 20. As a non-limiting example, the embodiment of FIGS. 1–3 shows a thirty-six element array. The support base 20 may comprise a pair of conductive (e.g., aluminum) plates that are spaced apart by and laminated with an intermediate honeycomb lattice, thereby providing a relatively lightweight structure, facilitating deployment in a variety of terminal environments. The support base 20 is affixed to an associated mounting and pointing arrangement, not shown, as by means of a pair of gimbal plates 23 at a diametrically opposed locations at the perimeter of the support base 20.

Figure 4:
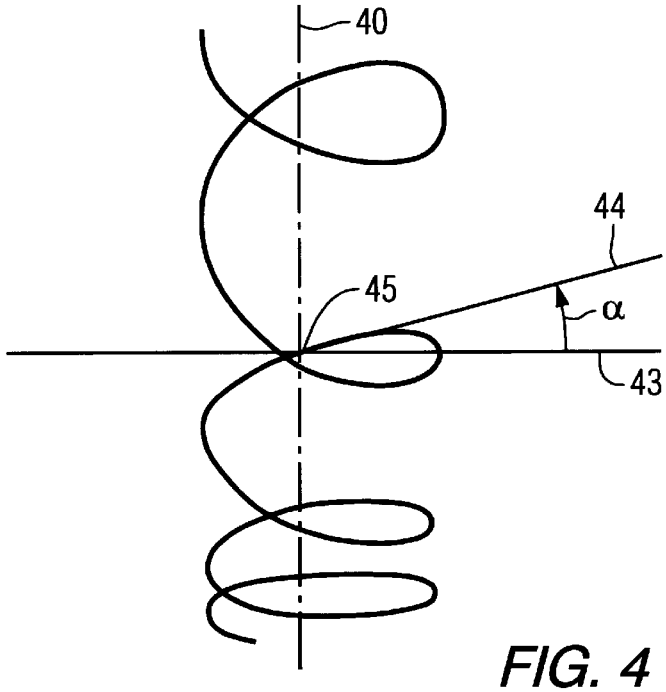
FIG. 4 diagrammatically illustrates the manner in which the pitch angle of an individual helical antenna element winding of the architecture of FIGS. 1–3 is tapered in accordance with the number of turns of the winding.

Each axial mode helical antenna element 10 preferably has a tapered winding configuration of the type described in copending U.S. patent application Ser. No. 08/838,546, by William D. Killen, entitled: "Variable Pitch Angle Axial Mode Helical Antenna," filed Apr. 9, 1997, assigned to the assignee of the present application and the disclosure of which is incorporated herein. As such, each helical antenna includes a generally cylindrical rectilinear shaft 11, a base portion 12 of which is mounted by way of a circular mounting bracket 13 to the first side 21 of the support base 20, so that the helical antenna element extends normal to the first side 21 of the support plate and is parallel to the antenna's boresight axis 30. Extending from the distal end 14 of each helical antenna element 10 is a helical winding 15, the pitch of which tapers from a maximum pitch at the distal end 14 of the element to a minimum pitch at its base portion 12, as will be described below with reference to FIG. 4.

Each axial mode helical winding 15 is coupled to a coaxial feed-through element, which passes through the support base 20 to the second side 22 thereof, for connection to a first end 41 of a section of signal coupling cable 40, a second end 43 of which is coupled to a signal distribution unit 50, that is mounted to the second side 22 of the support plate. The signal distribution unit 50 contains a signal network through which the antenna beam or radiation pattern may be controllably defined relative to the boresight axis 30.

As pointed out briefly above, pursuant to the invention, the axial mode helical antenna elements 10 have a tapered pitch configuration and are distributed around the antenna boresight axis 30, in a prescribed spatially aperiodic array having an irregular distribution geometry and mutual separation that are effective to minimize grating lobes and optimize the gain of the overall array. In particular, in accordance with a first aspect of the invention, the antenna elements have a spatially aperiodic distribution, that serves to minimize grating lobes by minimizing the number of antenna elements which share the same azimuth.

This is effectively achieved by arranging the elements, such that, for any given antenna element of the array, a radial line orthogonal to the boresight axis will intercept a minimum number of (e.g., only one or two) helical antenna elements of the array. In other words, no matter what the azimuth look angle (relative to the center of the array), that look angle will intercept or be aligned with a minimum number of helical elements of the array.

Such a spatially aperiodic relationship is diagrammatically illustrated in the distribution of FIG. 1, wherein a radial line **25*i* passing through an arbitrary antenna element 10*i* of the array, and being orthogonal to the boresight axis 30 (e.g., lying in the plane of the first side 21 of the support base 20) intercepts no more than one other helical antenna element of the array, here only antenna element 10*j***.

In accordance with a second aspect of the invention, to minimize mutual coupling between elements, the mutual spacing among the elements of the array should be as large as practical. (For the case of a relatively simple example of only three elements in the array , this means that the elements would be distributed around the boresight axis at successive 120° mutual angular separations and maximum separation allowed by the mounting structure). In practical terms (e.g., for a relatively large number of elements, such as the thirty-six element array shown in FIG. 1, for example), the spacing between any two antenna elements of the array is defined as being at least twice the wavelength of the operating frequency of the antenna, for a 17 dBiC helix.

Specifically, the mutual spacing between any two elements of the array conforms with a prescribed gain-based spacing relationship, wherein a first arbitrary antenna element **10*i* is spaced apart from any other antenna element 10*k*** by a minimum spacing Sik=(Gi/4pi)$^{1/2}$*lambda, where Gi is the gain of the respective helical antenna **10*i***, and lambda is the wavelength of the operating frequency of the array.

Pursuant to a third aspect of the invention, in order to maximize the composite gain characteristic of the array in a relatively compact architecture, the gain of each helical element is optimized relative to helix length for a given physical size of the winding, by tapering the pitch along each helical winding, as described for example, in the above-referenced Killen application. To maximize the gain/length ratio for a given size of a respective helical element, the taper of the helical winding pitch is defined in accordance with the number of turns of the helical winding.

This relationship is such that, at any location along its length, the tapered winding of a respective axial mode helical antenna element has a pitch angle that is tailored to optimize the exchange of energy between a free space wave and current flowing in the helical winding. This pitch angle relationship is diagrammatically illustrated in FIG. 4, wherein the pitch angle is the angle $\alpha$ between a plane 43 normal to the winding axis 40 and a line 44 tangential to the selected location 45 on the helical winding. The largest value of pitch angle $\alpha$ is at the distal end 14 of the antenna shown in FIG. 2, while the smallest value of pitch angle $\alpha$ is at the feed port at its base 12. For C-band operation, the pitch angle $\alpha$ at the distal end of the antenna, which the spacing between turns is largest, may have a value on the order of 20–30 degrees (and particularly on the order of 23–26 degrees), while the pitch angle $\alpha$ at the feed port 36, where the spacing between turns is smallest, may have a value on the order of 3–8 degrees (and particularly on the order of 3–6 degrees).

Between these distal and feed locations, the pitch angle along successive turns of the helical winding 15 varies in accordance with the relationship between the phase velocity of a wave propagating through the antenna and the phase velocity of a free space electromagnetic wave interfaced with the antenna. Parametric measurements along successive turns of the antenna have revealed that this phase velocity variation is not linear. As a consequence, it is preferred that the pitch angles of successive turns of the antenna be varied in a corresponding non-linear manner, so as to optimally match the phase velocity of a free space electromagnetic wave interfaced with (received or launched by) the antenna with the phase velocity of the wave travelling through the antenna. What results is an axial mode, helical antenna that has several more dB of gain than would otherwise be provided by a constant pitch angle configuration of similar axial length. Also, the variable pitch angle helix of the present invention is capable of achieving, in absolute terms, more gain than a helix having a fixed pitch angle.

For this purpose, the pitch angle $\alpha_i$ in degrees at any turn i along a helical winding of N turns, relative to the distal end thereof, is preferably defined in accordance with equation (1) as:

$$\alpha_i = 5 + \left(\frac{i-1}{N-1}\right)(10\log N - 5) \tag{1}$$

Such tapering of the pitch angle of the helical winding allows the use of considerably shorter helical winding than would otherwise be possible for the case of a constant pitch angle winding. This results in a much more compact and lighter weight antenna array, particularly where the number of antenna elements is relatively large (as in the case of the thirty-six element array of the present example).

Figure 5:
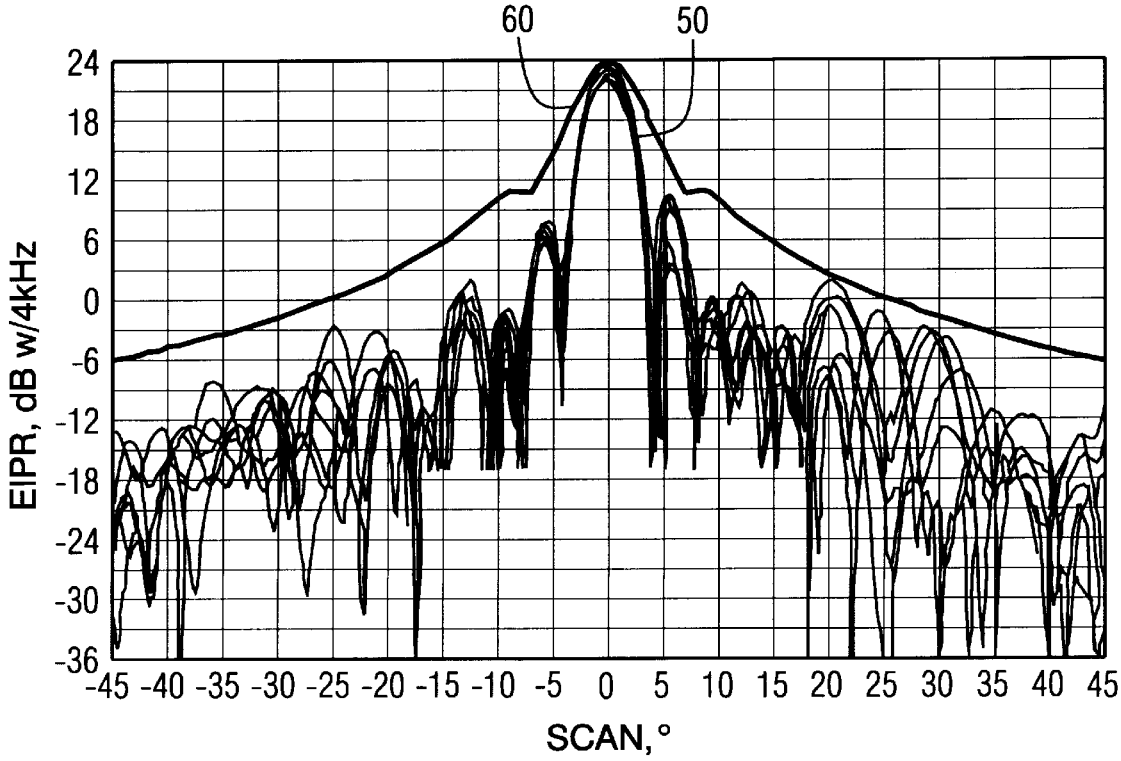
FIG. 5 is effective irradiated power (EIRP) density vs. scan angle characteristic of a gain-optimized, helical antenna architecture of the present invention.

FIG. 5 is a plot of the performance of an antenna configuration of the present invention, described above, illustrating an effective irradiated power (EIRP) density vs. scan angle characteristic 50, that falls within the baseline 60 currently required by INTELSAT, which exempts the array from formal verification testing, and thereby facilitates link implementation.

As will be appreciated from the foregoing description, mutual coupling and grating lobe problems of conventional axial mode antenna arrays are substantially reduced or eliminated by the relatively compact helical antenna configuration of the present invention. Aperiodically distributing a plurality of tapered pitch helical antenna elements around the antenna's boresight axis, and separating the elements by a distance of at least two wavelengths for a 17 dBiC helix not only minimizes grating lobes, but optimizes the gain of the overall array.

While I have shown and described an embodiment in accordance with the present invention, it is to be understood that the same is not limited thereto but is susceptible to numerous changes and modifications as are known to a person skilled in the art, and I therefore do not wish to be limited to the details shown and described herein, but intend to cover all such changes and modifications as are obvious to one of ordinary skill in the art.

What is claimed:

1. An antenna arrangement comprising:

a plurality of helical antenna elements extending from a generally planar surface, each helical antenna element having a helical antenna axis orthogonal to said generally planar surface, and being distributed around a boresight axis of said antenna arrangement, said boresight axis being orthogonal to said generally planar surface such that any radial line through and orthogonal to said boresight axis and intercepting a helical axis of any of said helical antenna elements intercepts a helical antenna axis of no more than one other of said helical antenna elements; and a power distribution circuit configured to interface a signal input/output port with said plurality of helical antenna elements.

2. An antenna arrangement according to claim 1, wherein each of said helical antenna elements is spaced apart from every other helical antenna element of said plurality by at least two wavelengths of an operating frequency of said antenna.

3. An antenna arrangement according to claim 2, wherein mutual spacing between any two helical antenna elements of the array conforms with a prescribed gain-based spacing relationship, such that any helical antenna element is spaced apart from any other helical antenna element by a minimum separation that is proportional to a product of the square root of the gain of the respective helical antenna element and the wavelength of the operating frequency of said antenna arrangement.

4. An antenna arrangement according to claim 3, wherein a respective helical antenna element i is spaced apart from every other helical antenna element j by a minimum spacing $Sij=(Gi/4pi)^{1/2}*lambda$, where Gi is the gain of said respective helical antenna i, and lambda is the wavelength of the operating frequency of said antenna arrangement.

5. An antenna arrangement according to claim 3, wherein said helical antenna elements comprise variable pitch helical antenna elements.

6. An antenna arrangement according to claim 5, wherein the pitch angle $\alpha_i$ in degrees of a respective winding wi of a respective one of said plurality of helical antenna elements, relative to a feed location thereof, is equal to $5+(i-1)(N-1)^{-1}(10logN-5)$ degrees, where N is the total number of turns of said respective winding.

7. An antenna arrangement according to claim 6, wherein a respective helical antenna element i is spaced apart from every other helical antenna element j by a minimum spacing $Sij=(Gi/4pi)^{1/2}*lambda$, where Gi is the gain of said respective helical antenna i, and lambda is the wavelength of the operating frequency of said antenna arrangement.

8. An antenna arrangement according to claim 1, wherein said helical antenna elements comprise variable pitch helical antenna elements.

9. An antenna arrangement according to claim 8, wherein the pitch angle $\alpha_i$ in degrees of a respective winding wi of a respective one of said plurality of helical antenna elements, relative to a feed location thereof, is equal to $5+(i-1)(N-1)^{-1}(10logN-5)$ degrees, where N is the total number of turns of said respective winding.

10. A gain-optimized, compact helical antenna array comprising a spatially aperiodic array of tapered pitch angle helical antenna elements extending from a generally planar surface, each helical antenna element having a helical antenna axis orthogonal to said generally planar surface, and a signal distribution network, to which each helical antenna element is coupled and through which the antenna's radiation pattern is controllably defined, and wherein said spatially aperiodic distribution is such that for any helical antenna element, a radial line orthogonal to a boresight axis of said array, said boresight axis being orthogonal to said generally planar surface, and intercepting a helical axis of any of said helical antenna elements intercepts a helical antenna axis of no more than one other of said helical antenna elements of the array, and wherein mutual spacing between any two antenna elements of the array is at least a minimum spacing $Sij=(Gi/4pi)^{1/2}*lambda$, where Gi is the gain of a respective helical antenna element i, and lambda is the wavelength of the operating frequency of said array.

11. A gain-optimized, compact helical antenna array according to claim 10, wherein the pitch angle $\alpha_i$ in degrees of a respective winding wi of a respective one of said plurality of tapered pitch helical antenna elements, relative to a feed location thereof, is equal to $5+(i-1)(N-1)^{-1}(10logN-5)$ degrees, where N is the total number of turns of said respective winding.

12. An antenna arrangement comprising:

a plurality of variable pitch helical antenna elements extending from a generally planar surface, each helical antenna element having a helical axis orthogonal to said generally planar surface, and being arranged in a spatially aperiodic distribution relative to a boresight axis of said antenna arrangement, said boresight axis being orthogonal to said generally planar surface; and a power distribution circuit configured to interface a signal input/output port with said plurality of variable pitch helical antenna elements, and wherein said plurality of helical antenna elements are parallel to and distributed around said boresight axis and intercepting a helical axis of any of said helical antenna elements of said antenna arrangement, such that a radial line through and orthogonal to said boresight axis intercepts a helical antenna axis of no more than one other of said helical antenna elements.

13. An antenna arrangement according to claim 12, wherein each of said helical antenna elements is spaced apart from every other helical antenna element of said plurality by at least a minimum spacing of $Sij=(Gi/4pi)^{1/2}*lambda$, where Gi is the gain of a respective helical antenna element i, and lambda is the wavelength of the operating frequency of said antenna arrangement.

14. An antenna arrangement according to claim 12, wherein mutual spacing between any two helical antenna elements of said array conforms with a prescribed gain-based spacing relationship, such that any helical antenna element is spaced apart from any other helical antenna element by a minimum separation that is proportional to a product of the square root of the gain of the respective helical antenna element and the wavelength of the operating frequency of said antenna arrangement.

15. An antenna arrangement according to claim 14, wherein a respective helical antenna element i is spaced apart from every other helical antenna element j by a minimum spacing $Sij=(Gi/4pi)^{1/2}*lambda$, where Gi is the gain of said respective helical antenna i, and lambda is the wavelength of the operating frequency of said antenna arrangement.

16. An antenna arrangement according to claim 12, wherein the pitch angle $\alpha_i$ in degrees of a respective winding wi of a respective one of said plurality of variable pitch helical antenna elements, relative to a feed location thereof, is equal to $5+(i-1)(N-1)^{-1}(10\log N-5)$ degrees, where N is the total number of turns of said respective winding.

* * * * *